United States Patent [19]

Boggs

[11] Patent Number: 4,730,604

[45] Date of Patent: Mar. 15, 1988

[54] ARHYTHMIC BABY BED

[76] Inventor: Randy S. Boggs, 111 Belmont Ave., Asheville, N.C. 28806

[21] Appl. No.: 26,086

[22] Filed: Mar. 16, 1987

[51] Int. Cl.[4] ..... A61H 23/04; A61H 1/00

[52] U.S. Cl. ..... 128/33; 128/38; 5/449; 5/452

[58] Field of Search ..... 128/33, 38, 39, 40, 128/32, 64, 24 R, 44; 5/423, 422, 449, 451, 452, 461; 261/121.1

[56] References Cited

U.S. PATENT DOCUMENTS

| | | | |
|---|---|---|---|
| 3,390,674 | 7/1968 | Jones | 128/33 |
| 3,446,203 | 5/1969 | Murray | 128/33 |
| 3,467,081 | 9/1969 | Glass | 128/33 |
| 3,477,071 | 11/1969 | Emerson | 128/33 |
| 3,587,568 | 6/1971 | Thomas | 128/33 |
| 3,672,354 | 6/1972 | Weber | 128/33 |
| 4,066,072 | 1/1978 | Cummins | 128/33 |
| 4,068,334 | 1/1978 | Randall | 5/365 |
| 4,088,124 | 5/1978 | Korner et al. | 128/33 |
| 4,135,500 | 1/1979 | Gorran | 128/33 |
| 4,136,413 | 1/1979 | Scales | 5/423 |
| 4,225,989 | 10/1980 | Corbett . | |
| 4,292,701 | 10/1981 | Woyehick | 5/451 |
| 4,597,917 | 7/1986 | Lunsford | 261/121.1 |

*Primary Examiner*—Edgar S. Burr
*Assistant Examiner*—Huong A. Pham
*Attorney, Agent, or Firm*—Francis J. Bouda

[57] ABSTRACT

A baby bed is described which includes an air mattress connected to a bubble chamber consisting of a partially-filled container of fluid through which air is discharged and from which an arhythmic supply of air is supplied to the air mattress so that the surface of the mattress vibrates in an arhythmic fashion to prevent apnea.

3 Claims, 3 Drawing Figures

ARHYTHMIC BABY BED

BACKGROUND OF THE INVENTION

Since time immemorial mothers have been lulled their babies to sleep and nothing seems more natural than to have a cradle or a baby bed which is rocked rhythmically to induce sleep.

However, it has been only recently that the medical profession has understood the problem of apnea, particularly in premature infants.

It has been found important to stimulate infants, especially premature babies with gentle, non-cyclic vibrations to prevent apnea, and also to help keep the respiratory airways clear of secretions.

Recent inventors have developed a great variety of inflatable air mattresses which operate in a progressive manner, so as to provide an undulating or massaging effect. Particularly noteworthy of this prior art is the device shown in Glass U.S. Pat. No. 3,467,081 which is intended to provide a massaging or soothing action similar to the beating of a mother's heart.

A further illustration of this prior art approach is the device shown in Cummins U.S. Pat. No. 4,066,072.

Needless to say, the use of an air-inflatable mattress for many purposes, including medical support, is old in the art, and attention is drawn to Jones U.S. Pat. Nos. 3,390,675; Murray 3,446203; Emerson 3,477,071 and Randall 4,068,334.

The method and apparatus for providing a rhythmic oscillatory support for a body on an air mattress is shown in many of the foregoing patents, but especially in Gorran U.S. Pat. No. 4,135,500.

As has been stated, the purpose of the prior art has been primarily to provide a mattress filled with air for generally comfortable support, or if an oscillatory action is desired, it has apparently always been directed toward a rhythmic and regular periodic vibration.

In one prior art patent, Thomas U.S. Pat. No. 3,587,568, the inventor had in mind precisely the goal of the present invention, namely, to inflate or deflate a mattress in out-of-phase relationship.

However, though the goal may be the same, the apparatus and method described by Thomas is a very complicated (and probably expensive) valve-arrangement to control the vibratory action.

SUMMARY OF THE INVENTION

The baby-fed or cradle of the present invention is directed to an air mattress, and particularly a portable mattress, which is constructed and arranged to inflate and deflate in out-of-phase relationship through a most simple mechanism which can be made available to all hospitals, ambulances and parents of premature infants in cases where there may be a threat of apnea. This is particularly important in private homes or ambulances where the high-tech equipment of a hospital is not available.

In the present invention, a simple air mattress is connected to a source of compressed air or oxygen or other gas under pressure. The air is caused to bubble erratically and irregularly into the air mattress which is contained in a fairly rigid box-like enclosure, so that only the upper surface of the mattress can vibrate.

Therefore, the principal object of the present invention is to provide an inexpensive air mattress for infants likely to be afflicted with apnea.

An additional object of the present invention is to provide a vibratory bed for infants, which bed may be connected to a source of compressed gas generally available to hospitals, ambulances, and the like.

Still another object of the present invention is to provide a crib or a bed for an infant which is caused to vibrate non-cyclically so as to prevent the likelihood of the patient suffering from apnea.

With the above and other objects in view, more information and a better understanding of the present invention may be achieved by reference to the following detailed description.

DETAILED DESCRIPTION

For the purpose of illustrating the invention, there is shown in the accompanying drawings a form thereof which is at present preferred, although it is to be understood that the several instrumentalities of which the invention consists can be various arranged and organized and that the invention is not limited to the precise arrangements and organizations of the instrumentalities as herein shown and described.

In the drawings, wherein like reference characters indicate like parts:

Figure 1:
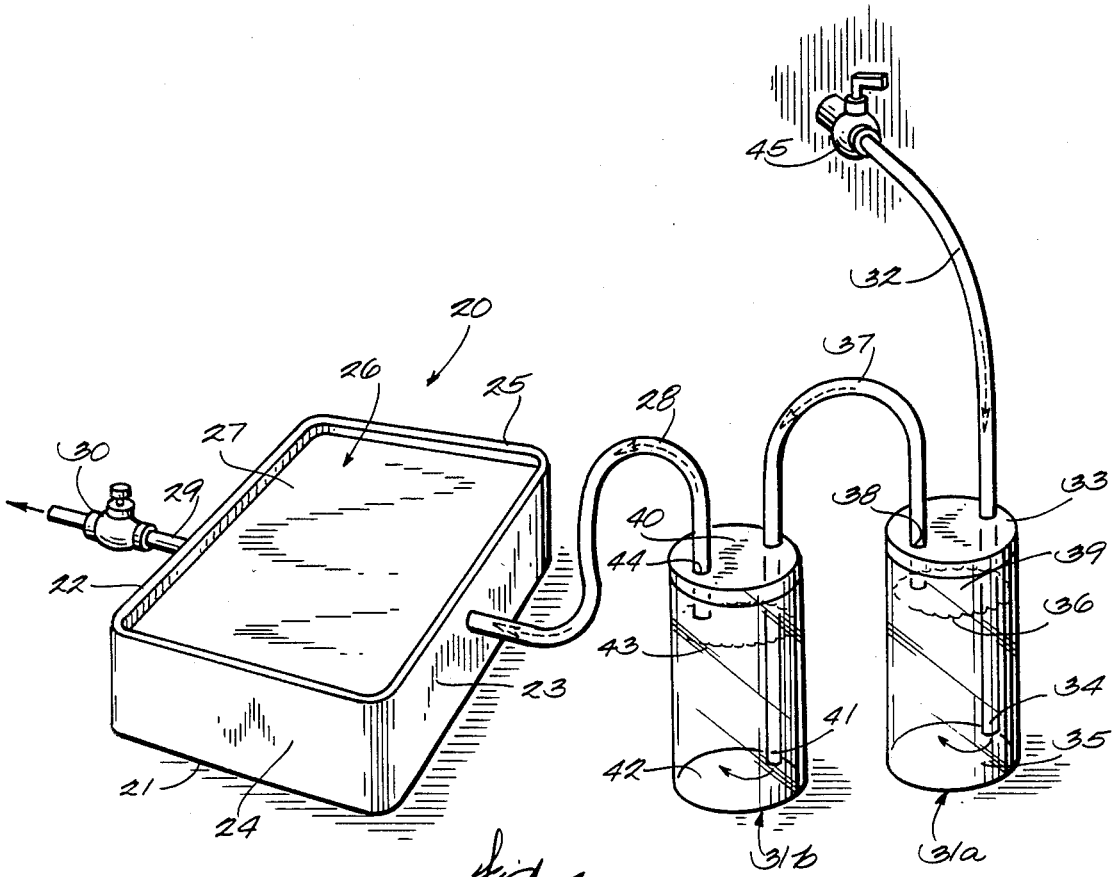
FIG. 1 is a perspective view of the crib and control mechanism of the present invention.
Figure 2:
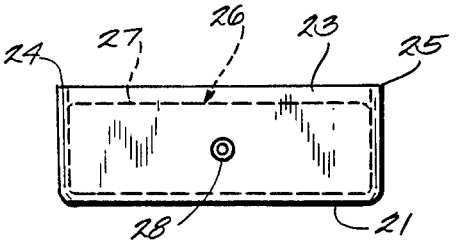
FIG. 2 is a schematic side elevational view of the crib of the present invention.
Figure 3:
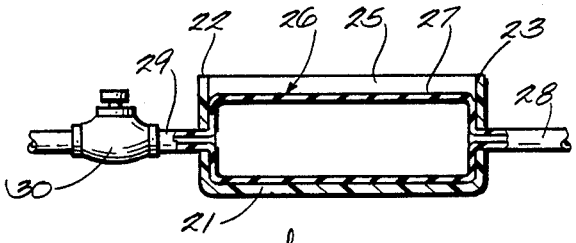
FIG. 3 is a vertical cross-sectional view of the air mattress and holder of the crib of the present invention.

The crib and control device of the present invention includes a box-like crib or support 20, having rigid bottom 21 and side walls 22 and 23, and end walls 24 and 25.

An air mattress 26 is supported within the rigid container 20 and fits snugly therein so that only the upper surface 27 is free to vibrate.

An air inlet tube 28 is connected to the mattress 26. An air outlet 29, also secured thereto, has a metering or control valve 30 disposed in the outlet line 29.

Connected to the air inlet line 28 is at least one bubble chamber 31. In FIG. 1 I have chosen to illustrate two of such bubble chambers, **31*a* and 31*b***.

Into the first chamber **31*a*, an air inlet line 32 passes through the cover 33, and the end thereof, 34, terminates near the bottom 35 of the bubble chamber 31*a***.

The bubble chamber **31*a* is partially filled with water 36**.

A connecting hose 37 is fastened to the lid 33 at the opening 38 so that air trapped in the upper portion 39 of the bubble chamber **31*a* may pass out through the hose 37 into the second bubble chamber 31*b* through its cover 40. The bottom end 41 of the tube 37 terminates adjacent the bottom 42 of the bubble chamber 31*b***.

As in the case of the first bubble chamber, the second bubble chamber **31*b* is also filled with water 43**.

The air mattress hose 28 is connected to the cover of the bubble chamber **31*b* at the opening 44**.

The air inlet tube 32 is then connected to a source of compressed air, such as the outlet valve 45 of the type which is found in many ambulances and hospitals and supplies oxygen or other compressed gases.

When the valve 45 is opened, air passes through the conduit 32 into the first bubble chamber **31*a*, bubbling up through the water 36. This accumulation of bubbles then permits the excess air to pass upwardly and outwardly from the bubble chamber 31*a* through the tube 37 into the water 36 in the second bubble chamber 31*b***.

Here it bubbles up through the water 36 into the upper portion 39 of the bubble chamber 31*b*, and as the bubbles collect and burst in the upper portion of the bubble chamber 31*b*, the cumulative gases pass out through the tube 28 into the air mattress 26, causing the upper surface thereto to vibrate arhythmically, and thus irregularly stimulate the breathing of an infant placed upon the mattress.

The rate of discharge of the air from the arrangement is controlled through the valve 30, and by proper balancing the position of the valves 45 and 30 the quantity of air and the speed at which it flows through the system is controlled to cause more or less vibration and greater or lesser numbers of vibrations per minute. In any case, the vibrations are not periodic or rhythmic but are totally arhythmic.

I have found desirable to use air flowing through the system at the rate of about 10 to 15 leters per minute. I have also found that the bubbles which burst out of the first bubble chamber 31*a* do so in greater bursts than those which occur in the second bubble chamber 31*b*.

The discharge valve 30 not only controls the intensity of vibration but also aids in draining any water which may be carried to the mattress from the bubble chambers 31*a* and 31*b*. It is important to note that this system is non-invasive of the human body, is simple to operate and to maintain, and that the non-cyclical nature prevents the infant from developing the responsive pattern which might otherwise lead to an attack of apnea.

It is to be understood that the present invention may be embodied in other specific forms without departing from the spirit or special attributes hereof, and it is therefore desired that the present embodiments be considered in all respects as illustrative, and therefore not restrictive, reference being made to the appended claims rather than to the foregoing description to indicate the scope of the invention.

I claim:

1. In combination, an air mattress for supporting an infant, means for causing an arhythmic vibrations of the upper surface of said mattress, said means including at least one bubble chamber, said bubble chamber being partially filled with water, said bubble chamber having an air inlet conduit extending to below the level of said water, said bubble chamber having a second conduit extending to a point above the level of the water therein, and connected to said air mattress, said air mattress having a discharge conduit and a valve in said discharge conduit, said conduits, bubble-chamber and mattress being constructed so that a constant flow of air into the first bubble chamber will be converted to an erratic bubbling flow of air through the second conduit and into the mattress, thereby creating an arhythmic vibration of the upper surface of the mattress.

2. The apparatus of claim 1 wherein said air mattress is supported within an open-top container having rigid side walls and with the sides of the air mattress in contact with said side walls so that only the top of the mattress can vibrate.

3. The apparatus of claim 1 wherein two or more bubble chambers are connected in series.

* * * * *